US011015143B2

(12) United States Patent
Maldonado Ortega et al.

(10) Patent No.: US 11,015,143 B2
(45) Date of Patent: May 25, 2021

(54) CLEANING COMPOSITIONS AND METHODS FOR ENHANCING FRAGRANCE PERFORMANCE

(71) Applicant: Colgate-Palmolive Company, New York, NY (US)

(72) Inventors: Jorge Antonio Maldonado Ortega, Delegacion Miguel Hidalgo CP (MX); Edna Ambundo, Del. Miguel Hidalgo (MX); Jose Alejandro Flores Sanabria, Col Izcalli Piramide Tlalnepantla (MX); Antonia de la Cruz Ramirez Mendez, Mexico City (MX); Maria Eugenia Rojo Dieguez, Mexico D.F. (MX); Luis Javier Rivera Cruz, Mexico City (MX)

(73) Assignee: Colgate-Palmolive Company, New York, NY (US)

( * ) Notice: Subject to any disclaimer, the term of this patent is extended or adjusted under 35 U.S.C. 154(b) by 109 days.

(21) Appl. No.: 15/743,443

(22) PCT Filed: Jul. 10, 2015

(86) PCT No.: PCT/US2015/039933
§ 371 (c)(1),
(2) Date: Jan. 10, 2018

(87) PCT Pub. No.: WO2017/010971
PCT Pub. Date: Jan. 19, 2017

(65) Prior Publication Data
US 2018/0201877 A1 Jul. 19, 2018

(51) Int. Cl.

| | |
|---|---|
| ***C11D 1/00*** | (2006.01) |
| ***C11D 1/83*** | (2006.01) |
| ***C11D 1/37*** | (2006.01) |
| ***C11D 3/50*** | (2006.01) |
| *C11D 1/22* | (2006.01) |
| *C11D 1/29* | (2006.01) |
| *C11D 1/72* | (2006.01) |

(52) U.S. Cl.
CPC ..... *C11D 1/83* (2013.01); *C11D 1/37* (2013.01); *C11D 3/50* (2013.01); *C11D 1/22* (2013.01); *C11D 1/29* (2013.01); *C11D 1/72* (2013.01)

(58) Field of Classification Search
CPC ..... C11D 1/83; C11D 3/50; C11D 1/22
See application file for complete search history.

(56) References Cited

U.S. PATENT DOCUMENTS

| | | | | |
|---|---|---|---|---|
| 3,320,174 | A | 5/1967 | Rebenfeld | |
| 6,184,188 | B1 * | 2/2001 | Severns | C07C 69/007 510/101 |
| 6,342,473 | B1 | 1/2002 | Simon et al. | |
| 6,462,010 | B1 | 10/2002 | Aszman et al. | |
| 6,479,044 | B1 | 11/2002 | Mahieu et al. | |
| 8,309,504 | B2 | 9/2012 | Murphy et al. | |
| 2006/0111266 | A1 * | 5/2006 | Abera | C11D 1/83 510/504 |
| 2009/0143274 | A1 * | 6/2009 | Benes | C11D 1/22 510/492 |
| 2010/0317561 | A1 * | 12/2010 | Volkel | C11D 1/83 510/340 |

FOREIGN PATENT DOCUMENTS

| | | |
|---|---|---|
| EP | 2607469 A1 | 6/2013 |
| EP | 2770044 A1 | 8/2014 |
| WO | WO 2007/001593 | 1/2007 |

OTHER PUBLICATIONS

Binks et al., 2010, "Selective retardation of perfume oil evaporation from oil-in-water emulsions stabilized by either surfactant or nanoparticles," Langmuir 26(23):18024-18030.
Fischer et al., 2009, "Partitioning and localization of fragrances in surfactant mixed micelles," J. Surfactant Detergent 12:73-84.
Gilbert et al., 1987, "The oral retention and antiplaque efficacy of triclosan in human volunteers," Br. J. Clin. Pharmacology 23(5):579-583.
International Search Report and Written Opinion in Internation Application PCT/US2015/039933 dated Mar. 14, 2016.
Parker et al., 2013, "Viscoelasticity of anionic wormlike micelles: effects of ionic strength and small hydrophobic molecules," Soft Matter 9:1203-1213.
Patel, et al., 2011, "Advances in Oral Transmucosal Drug Delivery," J. Controlled Release 153(2):106-116.
Vona et al., 1998, "Location of fragrance molecules within lamellar liquid crystals," Colloids and Surfaces A 137:79-89.

* cited by examiner

*Primary Examiner* — Necholus Ogden, Jr.

(57) ABSTRACT

Disclosed are fragrance-enhanced cleaning compositions including a mixture of a linear alkyLbenzene sulfonate (LAS) and a sodium lauryl ether sulfate (SLES), wherein the mixture is present in the cleaning composition in an amount of about 1%-2% by weight and wherein a weight ratio of LAS:SLES is about 3:1 to about 1:1 or about 6:1 to about 4:1; and a fragrance. Methods of preparing and using the present cleaning compositions are also disclosed. In addition, methods of formulating a cleaning composition having an enhanced fragrance performance are provided.

5 Claims, 1 Drawing Sheet

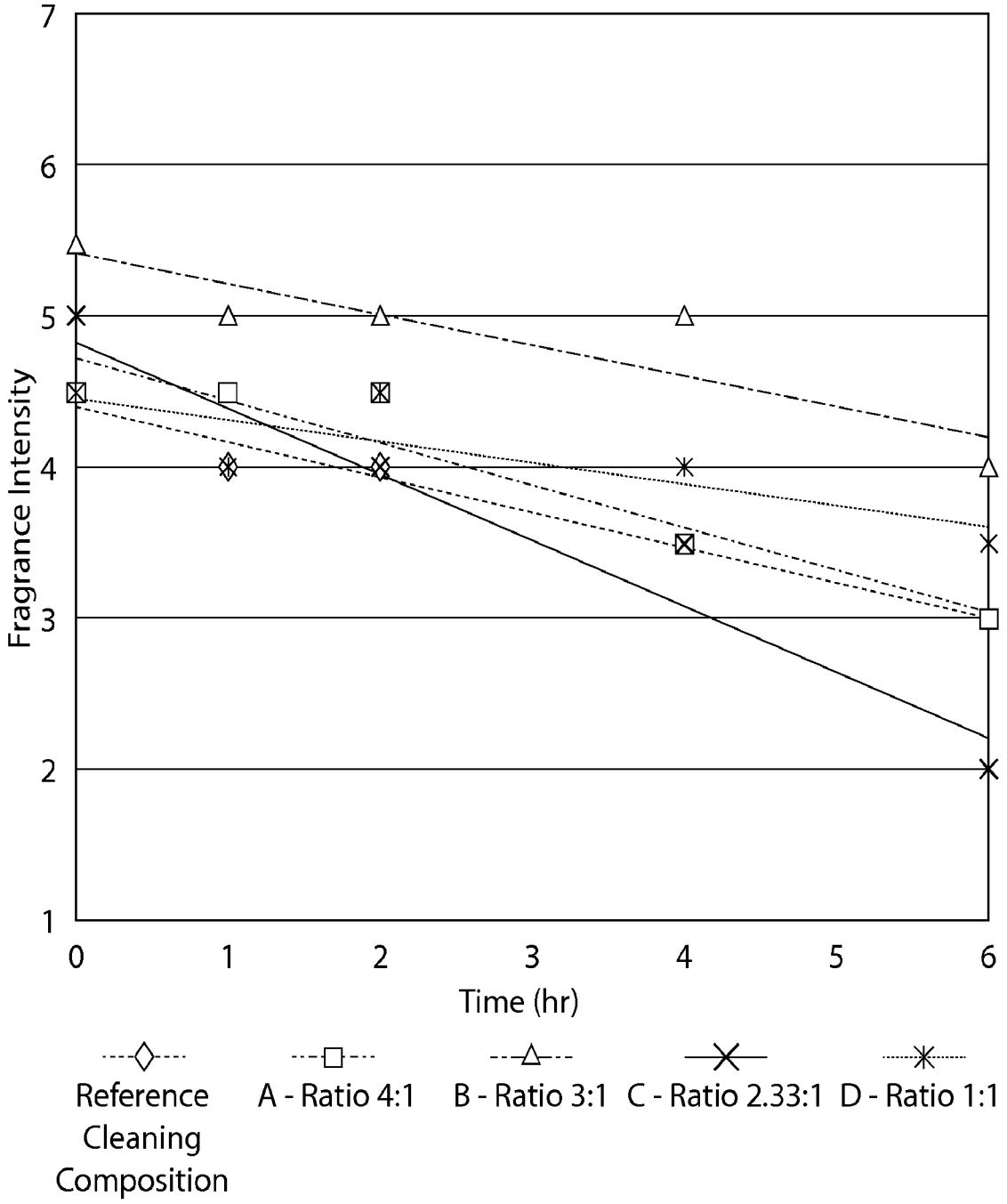
7
6
5
4
3
2
1
Fragrance Intensity
0
1
2
3
4
5
6
Time (hr)
Reference Cleaning Composition
A - Ratio 4:1
B - Ratio 3:1
C - Ratio 2.33:1
D - Ratio 1:1

CLEANING COMPOSITIONS AND METHODS FOR ENHANCING FRAGRANCE PERFORMANCE

BACKGROUND

Fragrance is a key performance characteristic of cleaning compositions. When consumers compare two cleaning products, such as bucket-dilutable cleaners, with the same base formula but with different types of fragrances, they often rate the product that has the more pleasant fragrance as a better cleaner. Consumers may also rate products with a more intense and/or longer-lasting fragrance as a better cleaner.

Two cleaning compositions containing the same amount and type of fragrance, however, may not result in the same fragrance performance (e.g., hedonics, release, long lastingness). Specific formula components such as surfactants, polymers and salts, for example, can interact with and impact fragrance performance. The traditional approach used to address any negative impact resulting from the interaction between formula ingredients and fragrance components has been to modify the composition of the fragrance to compensate for shortcomings in fragrance performance driven by the formula. However, depending upon cost and availability, modifying the composition of a fragrance, such as increasing the amount, may not be cost-effective or feasible. Accordingly, there is a desire in the art to increase fragrance performance in cleaning compositions without modifying the composition of a fragrance.

BRIEF SUMMARY

The present disclosure provides a fragrance-enhanced cleaning composition including: a mixture of a linear alkylbenzene sulfonate (LAS) and a sodium lauryl ether sulfate (SLES), wherein the mixture is present in the cleaning composition in an amount of about 1%-2% by weight and wherein a weight ratio of LAS:SLES is about 3:1 to about 1:1 or about 6:1 to about 4:1; and a fragrance.

Also provided herein is a method of preparing a cleaning composition with enhanced fragrance performance, wherein the cleaning composition includes a fragrance, the method including: combining a linear alkylbenzene sulfonate (LAS) and a sodium lauryl ether sulfate (SLES) to form a mixture having a weight ratio of LAS:SLES of about 3:1 to about 1:1 or about 6:1 to about 4:1; and adding the mixture to the cleaning composition in an amount of about 1%-2% by weight of the cleaning composition.

In addition, provided herein is method of formulating a cleaning composition having an enhanced fragrance performance including: providing a test cleaning composition including an amount of a fragrance, a linear alkylbenzene sulfonate (LAS) and a sodium lauryl ether sulfate (SLES), wherein a weight ratio of LAS:SLES includes a first weight ratio and wherein a total amount of LAS and SLES ranges from about 0.1 wt % to about 3.5 wt %; providing a reference cleaning composition including the amount of the fragrance, a linear alkylbenzene sulfonate (LAS) and a sodium lauryl ether sulfate (SLES), wherein a weight ratio of LAS:SLES includes a second weight ratio that is different from the first weight ratio and wherein a total amount of LAS and SLES ranges from about 0.1 wt % to about 3.5 wt %; evaluating a fragrance performance of the test cleaning composition and a fragrance performance of the reference cleaning composition, comparing the fragrance performance of the test cleaning composition and the fragrance performance of the reference cleaning composition, wherein an enhanced performance of the test cleaning composition in comparison to the reference cleaning composition indicates an enhanced fragrance performance formulation.

Further areas of applicability of the present disclosure will become apparent from the detailed description provided hereinafter. It should be understood that the detailed description and specific examples, while indicating the typical embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein:

FIG. 1 depicts the fragrance performance of four cleaning compositions of the present disclosure, formulations A-D, in comparison to a reference cleaning composition as described in the Example.

DETAILED DESCRIPTION

The following description of the typical embodiments is merely exemplary in nature and is in no way intended to limit the disclosure, its application, or uses.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Cleaning Compositions

The present disclosure is directed to cleaning compositions with enhanced fragrance performance. As described herein, fragrance performance is enhanced in the present cleaning compositions by modifying the amount and/or ratio of specific anionic surfactants in the formulation as described herein. Accordingly, in some embodiments, the cleaning compositions of the instant disclosure provide enhanced fragrance performance, without the need to increase or change the amount of fragrance.

As used herein, a "cleaning composition" is any composition that may be useful in cleaning substrates, such as household surfaces. A "surface" refers to the surface of any appliance or fixture, and may include hard surfaces such as counters, sinks, cabinets, walls, the surfaces of appliances such as kitchen appliances (e.g., stoves, conventional or microwave ovens, refrigerators, dishwashers and the like), or bathroom appliances and fixtures (e.g., sinks, toilets, bathtubs, tiles, shower curtains and doors), wood or glass surfaces, floors, utensils or dishes, as well as furniture or clothing (including carpets or rugs, cloths, bedding, leather, sponges and mops, polymeric or fabric surfaces or objects made from natural or synthetic materials, e.g., protective gear or sports equipment). Accordingly, the present compositions may be formulated into hard surface cleaners, spray cleaners, floor cleaners, microwave cleaners, stove top cleaners, etc.

Typically, the present cleaning compositions are in the form of a bucket-dilutable cleaner. As used herein, "bucket-dilutable" refers to a cleaning composition that may be (but does not necessarily have to be) diluted with water, for example, in a bucket or other container, prior to use.

In some embodiments, the cleaning compositions of the present disclosure comprise at least two anionic surfactants, typically, a linear alkylbenzene sulfonate (also referred to herein as LAS) and a sodium lauryl ether sulfate (also referred to herein as SLES). In various embodiments, the linear alkylbenzene sulfonate has a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Suitable linear alkylbenzene sulfonates that can be used in the present cleaning compositions include those in which the alkyls have 10 to 13 carbon atoms. Other suitable linear alkylbenzene sulfonates are found in U.S. Pat. No. 3,320,174, which is herein incorporated by reference in its entirety. Typically, the linear alkylbenzene sulfonate of the present cleaning compositions is sodium dodecyl benzene sulfonate.

In various embodiments, the present cleaning compositions contain sodium lauryl ether sulfate, also known as sodium laureth sulfate. In one embodiment, the sodium lauryl ether sulfate has an average of about 1 to about 10 moles of ethylene oxide per mole. In another embodiment, there is an average of about 2 to about 3 moles of ethylene oxide per mole.

In some embodiments, the anionic surfactants, for example, a combination of LAS and SLES, are present in the instant cleaning compositions in ratios and amounts that enhance the fragrance performance of the compositions in comparison to a reference cleaning composition as described herein. In other embodiments, a combination of LAS and SLES are present in the instant cleaning compositions in ratios and amounts that diminish the fragrance performance of the cleaning compositions in comparison to a reference cleaning composition as also described herein.

In some embodiments, the cleaning compositions of the present disclosure contain a total amount of anionic surfactant, such as a total amount of LAS and SLES combined, of about 0.1% to about 3.5% by weight, about 0.5% to about 2%, about 0.8% to about 1.5%, about 1% to about 2%, about 1.0% to about 1.3%, and about 1.6 to about 1.7%.

In some embodiments, the ratio of LAS to SLES ranges from about 6:1 to about 1:0, such as about 5:1 to about 1:1, about 4:1 to about 1:1, about 3:1 to about 1:1 and about 2:1 to about 1:1. More typically, the ratio of LAS to SLES ranges from about 3:1 to about 1:1 or about 6:1 to about 4:1.

In some embodiments, a cleaning composition of the instant disclosure contains a total amount of LAS and SLES of about 1%-2% by weight, wherein the LAS:SLES is present in the composition at a ratio of about 4:1. In various embodiments, this amount and ratio results in an increase in fragrance performance in comparison to a standard, such as a reference cleaning composition containing the same amount and type of fragrance as the present cleaning composition, but wherein the LAS and SLES are present in the reference cleaning composition in a total amount of about 1%-2% by weight at an LAS:SLES ratio of about 3.33:1.

In some embodiments, a cleaning composition of the instant disclosure contains a total amount of LAS and SLES of about 1%-2%, wherein the LAS:SLES is present in the composition at a ratio of about 2.3:1. In various embodiments, this amount and ratio results in an increase in fragrance performance in comparison to a standard, such as a reference cleaning composition, containing the same amount and type of fragrance as the present cleaning composition, but wherein the LAS and SLES are present in the reference cleaning composition in a total amount of about 1%-2% by weight at an LAS:SLES ratio of about 3.33:1.

In some embodiments, a cleaning composition of the instant disclosure contains a total amount of LAS and SLES of about 1%-2%, wherein the LAS:SLES is present in the composition at a ratio of about 1:1. In various embodiments, this amount and ratio results in an increase in fragrance performance in comparison to a standard, such as a reference cleaning composition, containing the same amount and type of fragrance as the present cleaning composition, but wherein the LAS and SLES are present in the reference cleaning composition in a total amount of about 1%-2% by weight at an LAS:SLES ratio of about 3.33:1.

In some embodiments, a cleaning composition of the instant disclosure contains a total amount of LAS and SLES of about 1%-2%, wherein the LAS:SLES is present in the composition at a ratio of about 3:1. In various embodiments, this amount and ratio results in an increase in fragrance performance in comparison to a standard, such as a reference cleaning composition containing the same amount and type of fragrance as the present cleaning composition, but wherein the LAS and SLES is present in the reference cleaning composition in a total amount of about 1%-2% by weight at an LAS:SLES ratio of about 3.33:1.

In some embodiments, the present cleaning composition further contains a nonionic surfactant. Suitable nonionic surfactants include water soluble nonionic surfactants, which are commercially well known and include the primary aliphatic alcohol ethoxylates, secondary aliphatic alcohol ethoxylates, alkylphenol ethoxylates and ethylene-oxide propylene oxide condensates on primary alkanols, such a PLURAFAC™ surfactants and condensates of ethylene oxide with sorbitan fatty acid esters such as the TWEEN™ surfactants. More typically, nonionic surfactants are chosen from primary alcohol ethoxylates, such as C9 to C11 alcohols. Exemplary C9 to C11 alcohol ethoxylates may include NEODOL® 91-8, also known as C9-C11 Pareth 8, a polyethylene glycol ether with an average of 8 moles of ethylene oxide per mole of alcohol. Other suitable nonionic surfactants are described in International Publication WO 2007/001593 to Simon et al. and U.S. Pat. No. 6,342,473 to Kott et al., herein incorporated by reference in their entireties. In various embodiments, the nonionic surfactant is present in amounts of about 0.5% to about 6%, about 1% to 4.5%, about 2% to about 3.5%, typically about 3%, more typically, about 1.25%, even more typically about 0.4%-1%, such as 0.5%-1% by weight of the cleaning composition.

In some embodiments, the present cleaning composition contains one or more fragrances. As used herein the term "fragrance" is used in its ordinary sense to refer to and include any fragrant substance or mixture of substances including natural (i.e., obtained by extraction of flower, herb, blossom or plant), and/or artificial (i.e., mixture of natural oils or oil constituents and/or synthetically produced substances) odoriferous substances. Typically, fragrances are complex mixtures or blends of various organic compounds such as alcohols, aldehydes, esters, and varying amounts of essential oils.

Suitable alcohols which may be used in a fragrance include farnesol, geraniol, linalool, nerol, phenylethyl alcohol, rhodinol, cinnamic alcohol, (Z)-hex-3-en-1-ol, menthol, α-terpineol. Suitable aldehydes include citral, α-hexyl cinnamaldehyde, Lilial, methylionone, verbenone, nootkatone, geranylacetone. Suitable esters include allyl phenoxyacetate, benzyl salicylate, cinnamyl propionate, citronellyl acetate, decyl acetate, dimethylbenzylcarbinyl acetate, dimethylbenzylcarbinyl butyrate, ethyl acetoacetate, cis-3-hexenyl isobutyrate, cis-3-hexenyl salicylate, linalyl acetate, methyl dihydrojasmonate, styralyl propionate, vetiveryl acetate, benzyl acetate, geranyl acetate.

Suitable essential oils include Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, Camphor powder synthetic technical, *Cananga* oil (Java), Cardamom oil, *Cassia* oil (China), Cedarwood oil (China) BP, Cinnamon bark oil, Cinnamon leaf oil, Citronella oil, Clove bud oil, Clove leaf, Coriander (Russia), Coumarin (China), Cyclamen Aldehyde, Diphenyl oxide, Ethyl vanilin, Eucalyptol, *Eucalyptus* oil, *Eucalyptus citriodora*, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, *Litsea cubeba* oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, *Sassafras* oil, Spearmint oil, Spike lavender, *Tagetes*, Tea tree oil, Vanilin, Vetyver oil (Java), Wintergreen, Allocimene, ARBANEX™, ARBANOL®, Bergamot oils, Camphene, Alpha-Campholenic aldehyde, I-Carvone, Cineoles, Citral, Citronellol Terpenes, Alpha-Citronellol, Citronellyl Acetate, Citronellyl Nitrile, Para-Cymene, Dihydroanethole, Dihydrocarveol, d-Dihydrocarvone, Dihydrolinalool, Dihydromyrcene, Dihydromyrcenol, Dihydromyrcenyl Acetate, Dihydroterpineol, Dimethyloctanal, Dimethyloctanol, Dimethyloctanyl Acetate, Estragole, Ethyl-2 Methylbutyrate, Fenchol, FERNLOL™, FLORILYS™, Geraniol, Geranyl Acetate, Geranyl Nitrile, GLIDMINT™, Mint oils, GLIDOX™, Grapefruit oils, trans-2-Hexenal, trans-2-Hexenol, cis-3-Hexenyl Isovalerate, cis-3-Hexanyl-2-methylbutyrate, Hexyl Isovalerate, Hexyl-2-methylbutyrate, Hydroxycitronellal, Ionone, Isobornyl Methylether, Linalool, Linalool Oxide, Linalyl Acetate, Menthane Hydroperoxide, I-Methyl Acetate, Methyl Hexyl Ether, Methyl-2-methylbutyrate, 2-Methylbutyl Isovalerate, Myrcene, Nerol, Neryl Acetate, 3-Octanol, 3-Octyl Acetate, Phenyl Ethyl-2-methylbutyrate, Petitgrain oil, cis-Pinane, Pinane Hydroperoxide, Pinanol, Pine Ester, Pine Needle oils, Pine oil, alpha-Pinene, beta-Pinene, alpha-Pinene Oxide, Plinol, Plinyl Acetate, Pseudo Ionone, Rhodinol, Rhodinyl Acetate, Spice oils, alpha-Terpinene, gamma-Terpinene, Terpinene-4-OL, Terpineol, Terpinolene, Terpinyl Acetate, Tetrahydrolinalool, Tetrahydrolinalyl Acetate, Tetrahydromyrcenol, TETRALOL®@, Tomato oils, Vitalizair, ZESTORAL™, HINOKITIOL™ and THUJOPSIS DOLABRATA™. Additionally, some suitable fragrances may be supplied by the fragrance houses as mixtures in the form of proprietary specialty accords.

The amount of fragrance or mixtures of fragrance that may be used in the cleaning compositions of the present disclosure range from about 0.001% to about 10%, typically from about 0.001% to about 5% by weight, more typically about 0.001% to about 1%, even more typically 0.5% to 2%, such as about 0.8% to about 0.9%.

In various embodiments, the compositions may further comprise additional ingredients, such as, for example, any other additives that are used in cleaning compositions, such as colorants, rheology modifiers, structuring agents, hydrotropes, whitening agents, reducing agents, enzymes, enzyme stabilizing agents, builders, bleaches, photobleaches, bleach catalysts, soil release agents, dye transfer inhibitors, buffers, soil repellents, water-resistance agents, suspending agents, aesthetic agents, preservatives and combinations thereof. An exemplary preservative may include isothiazolinone. These materials can be used in any desired amount.

In certain embodiments, the cleaning compositions disclosed herein are aqueous compositions. The amount of water can be any amount. In certain embodiments, the amount of water can be greater than 90% by weight of the composition, such as greater than 91%, greater than 92%, greater than 93%, or greater than 94% by weight of the composition. In certain embodiments, the amount of water is about 95% by weight of the composition or greater than about 95% by weight of the composition, such as greater than about 96%, greater than about 97%, or ranging from about 90% to about 98%.

In some embodiments, the compositions can be supplied as ready-to-use compositions. In other embodiments, the cleaning composition is supplied as a concentrate that can later be diluted with water. The composition can be at least 2, at least 3, at least 4, or at least 5 times concentrated, in which case the amounts of materials are adjusted accordingly.

In some embodiments, the ready-to-use compositions or the diluted compositions can be further diluted with water to any desired amount. In some embodiments, the ready-to-use or diluted cleaning compositions of the present disclosure can be further diluted at least 2, at least 3, at least 4, at least 5 times, at least 10 times, at least 40 times, at least 70 times or at least 100 times.

In some embodiments, the present cleaning compositions, including the diluted cleaning compositions, exhibit enhanced fragrance performance. As used herein "enhanced fragrance performance" means that the fragrance is quantitatively released from the present cleaning compositions in a greater amount, is perceived to be released in a greater amount and/or is released and/or is perceived to be released over a longer period of time in comparison to a standard, such as reference cleaning composition as described herein.

Any method known in the art for evaluating a fragrance may be used to assess fragrance performance. For example, to accurately determine the quantitative performance of the present cleaning compositions or dilutions of the present cleaning compositions, evaluating may include a headspace analysis performed using Solid Phase Micro Extraction ("SPME"). In brief, SPME essentially inserts a "trap" into the headspace vapor, typically a retentive coating applied to a narrow fused silica fiber, which collects compounds from the vapor as analytes. The fiber is typically attached to a stainless steel plunger in a protective holder. The collected analytes from the vapor are then thermally desorbed from the fiber and typically analyzed by a combination of gas chromatography (GC) and mass spectroscopy (MS). The GC separates the mixture into its individual components and the MS detects these components as they emerge from the end of the GC column. In MS, the analyte molecules are fragmented by a high energy stream of electrons which results in some analyte molecules ionized to a positive charge. The charged ions are then separated according to mass, counted and plotted versus intensity to provide a mass spectrum. Such a technique may be used to determine the amount or intensity of a fragrance released at various time points and these values may be compared to those of a standard, such as a reference cleaning composition, to assess the level of fragrance enhancement in the present cleaning compositions.

In other embodiments, the perceived amount of fragrance release or duration of fragrance release of the present cleaning compositions may be evaluated by a trained fragrance expert or a panel of experts using, for example, a magnitude estimation scaling technique. For this evaluation, each panelist is asked to smell a sample of a cleaning composition and then to rate the fragrance intensity relative to a standard, such as a reference cleaning composition. All product scores may then be divided by the standard and given a magnitude estimation score. Then, the panelists' scores are averaged for each cleaning composition.

In other embodiments, the panelists may be asked to rate the fragrance intensity over time. For example, the cleaning composition may be applied to a hard surface and the panelists may be asked to rate the fragrance intensity after the cleaning composition is first applied to the hard surface, and then to rate the fragrance intensity again after a given time period, e.g., after at least one hour, after at least two hours, after at least three hours, after at least four hours, after at least five hours or after six or more hours. In other embodiments, the panelists may be asked to rate the fragrance intensity after the cleaning composition has been diluted. The values assigned to the present cleaning compositions can be compared with those of a standard, such as a reference cleaning composition, to assess the level of fragrance performance of the present cleaning compositions.

As used herein "a reference cleaning composition" is a cleaning composition formulated to contain the same amount and type of a fragrance (also referred to herein as a "reference fragrance") and at least two of the same type of anionic surfactants as a cleaning composition of the present disclosure, e.g., the reference and the present cleaning compositions may both contain LAS and SLES and the same amount and type of fragrance. However, the weight and/or ratio of the at least two anionic surfactants, such as LAS and SLES, are different between the reference cleaning composition and the cleaning compositions of the present disclosure. For example, in some embodiments, a cleaning composition as described herein may be formulated to contain about 1% by weight of a fragrance, but will nevertheless be capable of releasing a greater amount of fragrance and/or releasing an amount of fragrance for a longer time period than a reference cleaning composition, which also contains about 1% by weight of the same fragrance, with the fragrance performance difference due to a varying or differing ratio of anionic surfactants, e.g., LAS and SLES.

In some embodiments, a reference cleaning composition contains the same anionic surfactants, nonionic surfactants and fragrance, as well as the same amounts of these ingredients, as the instant cleaning compositions, while the ratio of specific anionic surfactants, such as LAS and SLES, differs between the present cleaning compositions and a reference cleaning composition. For example, in some embodiments, the present cleaning compositions contain LAS:SLES ratios between about 3:1 and about 1:1 or about 6:1 to about 4:1, while the reference cleaning composition contains a LAS:SLES ratio of about 3.33:1.

In other embodiments, a reference cleaning composition contains the same anionic surfactants, nonionic surfactants and fragrance as the instant cleaning compositions, while the ratio and total combined amount of specific anionic surfactants, such as LAS and SLES, are different.

In yet other embodiments, a reference cleaning composition contains all of the same ingredients and amounts of ingredients as cleaning compositions of the present disclosure including anionic surfactants, nonionic surfactants, fragrance, buffer, coloring agent, preservatives and water, while the ratio of specific anionic surfactants and/or amounts of anionic surfactants, such as LAS and SLES, are different between the cleaning compositions of the present disclosure and a reference cleaning composition.

In some embodiments, the reference cleaning composition contains about 1%-2% by weight LAS and SLES, about 0.5%-1% by weight of nonionic surfactant and about 0.5-2% by weight of a fragrance.

In some embodiments, the ratio and/or total amount of anionic surfactants as described herein are adjusted in comparison to a reference cleaning composition, such as a commercially available reference cleaning composition, to obtain a cleaning composition having enhanced fragrance performance.

In other embodiments, the present cleaning compositions are formulated such that the fragrance performance is diminished in comparison to a standard, such as a reference cleaning composition. For example, a cleaning composition may be formulated for a consumer who prefers a more subtly fragranced cleaning composition or one having a fragrance that does not linger for a prolonged period of time.

Without being limited by theory, the present cleaning compositions, which include amounts of anionic surfactants, such as LAS and SLES, in particular amounts and ratios as described herein, impact the stability of the micelles in the composition, resulting in enhanced fragrance performance. The stability of the micelles present in the instant cleaning compositions and the metastability of the micelles is evident in the present neat cleaning compositions and also upon dilution of the neat formulation in water by evaluating via methods known in the art and as described herein in the Example, e.g., SPME of the headspace analyzed using gas chromatography-mass spectrometry and/or evaluation by an expert fragrance evaluator. In some embodiments, metastability of the micelles in diluted cleaning compositions may be evaluated by, for example, analyzing the turbidity of the present compositions. Turbidity analysis may be carried out by any well-known method.

Methods

The present disclosure is also directed to a method of preparing a cleaning composition with enhanced fragrance performance, and which is a mixture of ingredients. In some embodiments, the method includes combining at least two anionic surfactants, such as LAS and SLES, to form a mixture. The amounts and ratios of the at least two anionic surfactants used in the present methods are the same as previously described. Typically, about 1%-2% by weight of a combination of LAS and SLES is included in the mixture using a ratio of LAS to SLES of about 6:1 to about 1:1, such as about 3:1 to 1:1 or about 6:1 to 4:1. In some embodiments, fragrance is then added to the mixture. In various embodiments, water, nonionic surfactants, and additional components such as buffers, preservatives and coloring agents of the types and amounts described herein are also added to the mixture.

In other embodiments, the cleaning compositions disclosed herein can be used to clean substrates by applying the composition to a substrate and wiping the substrate. In certain embodiments, the cleaning composition is formulated to be a bucket dilutable cleaner.

The present disclosure is also directed to a method of formulating a cleaning composition having an enhanced fragrance performance by comparing the fragrance performance between a test cleaning composition and a standard, such as a reference cleaning composition, to determine whether or not, and/or to what degree, the test cleaning composition provides a formulation having an enhanced fragrance performance. In some embodiments, test and reference cleaning compositions are provided, which each include at least two anionic surfactants, such as LAS and SLES as described herein. In some embodiments, the total combined amount of LAS and SLES in the test and reference cleaning compositions ranges from about 0.1 wt % to about 3.5 wt %, such as about 1% to 2% by weight.

In some embodiments, the test cleaning composition includes a first weight ratio of LAS to SLES. In some embodiments, the first weight ratio is about 6:1 to about 1:1, such as about 5:1 to 1:1, such as about 4:1 to about 1:1, about 3:1 to about 1:1 and about 2:1 to about 1:1.

In various embodiments, the reference cleaning composition includes a second weight ratio of LAS to SLES. In some embodiments, the second weight ratio is about 6:1 to about 1:1, such as about 1:1 to about 1:1, such as about 4:1 to about 1:1, about 3:1 to about 1:1 and about 2:1 to about 1:1. Typically, the first weight ratio of the test cleaning composition is different from the second weight ratio of the reference cleaning composition.

In some embodiments, the total combined amount of the at least two anionic surfactants, such as LAS and SLES, are different between the test cleaning composition and the reference cleaning composition, while the weight ratio of the at least two anionic surfactants, such as LAS to SLES, are the same.

In other embodiments, the total combined amount of the at least two anionic surfactants, such as LAS and SLES, are the same in the test cleaning composition and the reference cleaning composition, while the weight ratios of the at least two anionic surfactants, such as LAS to SLES, are different.

In yet other embodiments, the total combined amount of the at least two anionic surfactants, such as LAS and SLES, and the weight ratios between the test cleaning composition and the reference cleaning composition are different.

In various embodiments, the test and reference cleaning compositions each contain the same amount and type of at least one fragrance as described herein. The test and reference cleaning compositions also may contain nonionic surfactants, water and additional components such as buffers, preservatives, coloring agents and water in the types and amounts described herein.

In some embodiments, the above-described formulation methods further include evaluating the cleaning compositions to assess their performance. Any method known in the art for evaluating a fragrance may be used. For example, in various embodiments, fragrance performance values may be obtained using SPME, a panel of experts or an individual expert fragrance evaluator. The thus obtained performance values may be compared between the test and reference cleaning compositions to determine if a higher or lesser amount of a fragrance is released or perceived from the test composition in comparison to the reference composition or to determine if the amount of fragrance released over time, e.g., one hour, two hours, three hours, four hours or six hours or more, is greater or less than in the test cleaning composition. An increase in fragrance release and/or an increase in the release of fragrance over time observed from the test cleaning composition in comparison to the reference cleaning composition indicates that the test cleaning composition provides a formulation having an enhanced fragrance performance.

EXAMPLES

Example 1

Formula Composition

Cleaning compositions with varying wt/wt ratios of LAS to SLES were prepared and evaluated. The formulations of prototype cleaning compositions, A-D and a reference cleaning composition are shown in Table 1, below. The same amount and type of fragrance was used in each of the prototypes evaluated. The fragrance performance of each of the prototypes was evaluated and compared with a reference cleaning composition also containing the same fragrance and amount of fragrance (reference fragrance).

Fragrance Evaluation

The fragrance intensity of the diluted prototypes was evaluated initially and over time in order to assess the fragrance performance of each of the diluted prototypes. A volume of from 2-10% wt/wt diluted product in tap water was prepared and applied to a cloth. The cloth was placed in a 4.5 L glass jar, which was closed and only opened to allow for fragrance assessment at specific time points. Fragrance intensity was evaluated at t=0 hrs (15 minutes after product application) and then at 1, 2, 4 and 6 hrs, respectively. Prototypes A-D as well as the reference cleaning composition, were evaluated blind, in replicate, by an expert fragrance evaluator and were rated on a fragrance intensity scale of 1 to 7, with 7 being the highest fragrance intensity. An example of the fragrance intensity profiles for cleaning compositions A-D and the reference cleaning composition is shown in FIG. 1.

As is evident from FIG. 1, when LAS:SLES is used in the cleaning composition in an amount of 1%-2% by weight at a ratio of 3:1 (cleaning composition B), both the initial intensity of the fragrance and the intensity of the fragrance over a six hour time period is enhanced in comparison to the reference cleaning composition. When LAS:SLES is used in the cleaning composition in an amount of 1%-2% by weight at a ratio of 2.3:1 (cleaning composition C) or in an amount of 1%-2% by weight at a ratio of 1:1 (cleaning composition D), initial intensity or the intensity of the fragrance after six hours, respectively, is also enhanced in comparison to the reference cleaning composition. And, a cleaning composition containing LAS:SLES in an amount of 1%-2% by weight at a ratio of 4:1 (cleaning composition A) exhibits an initial intensity of the fragrance that is enhanced in comparison to the reference cleaning composition. Accordingly, as is evident from the data shown in FIG. 1, the initial fragrance release and/or the fragrance release of the present cleaning compositions over time are impacted by the level and ratio of LAS and SLES present in the respective formulations. These differences can be repeatedly detected by an expert fragrance evaluator.

TABLE 1

| Material | Reference Cleaning Composition | A Ratio 4:1 | B Ratio 3:1 | C Ratio 2.33:1 | D Ratio 1:1 |
|---|---|---|---|---|---|
| Anionic Surfactant (LAS/SLES) | 1%-2% | 1%-2% | 1%-2% | 1%-2% | 1%-2% |
| Nonionic-surfactant (C9-C11 Pareth 8) | 0.5%-1% | 0.5%-1% | 0.5%-1% | 0.5%-1% | 0.5%-1% |
| Reference Fragrance | 0.5%-2% | 0.5%-2% | 0.5%-2% | 0.5%-2% | 0.5%-2% |
| Buffer | <0.5% | <0.5% | <0.5% | <0.5% | <0.5% |
| Color | <0.01% | <0.01% | <0.01% | <0.01% | <0.01% |
| Preservative | <0.1% | <0.1% | <0.1% | <0.1% | <0.1% |
| Water | Q.S. to match 100% | Q.S. to match 100% | Q.S. to match 100% | Q.S. to match 100% | Q.S. to match 100% |

Materials shown as % active ingredient based on a wt/wt %

What is claimed is:

1. A fragrance-enhanced cleaning composition consisting of:

a mixture of a linear alkylbenzene sulfonate (LAS) and a sodium lauryl ether sulfate (SLES), wherein the mixture is present in the cleaning composition in an amount of about 1%-2% by weight and wherein a weight ratio of LAS:SLES is selected from the group consisting of about 3:1 to about 1:1 and about 6:1 to about 4:1;

a nonionic surfactant of $C_9$-$C_{11}$ alkanol condensed with 2.5 to 10 moles of ethylene oxide present in the composition in an amount of about 0.5-1% by weight;

a fragrance present in the cleaning composition in an amount of about 0.5% to about 2% by weight;

a buffer;

a preservative; and water.

2. The fragrance-enhanced cleaning composition of claim 1, wherein the cleaning composition is a bucket-dilutable cleaning composition.

3. The fragrance-enhanced cleaning composition of claim 1, wherein the LAS:SLES ratio is about 3:1.

4. The fragrance-enhanced cleaning composition of claim 1, wherein the nonionic surfactant is C9-C11 Pareth 8.

5. The fragrance-enhanced cleaning composition of claim 1, wherein the cleaning composition exhibits an enhanced fragrance performance in comparison to a reference cleaning composition.

* * * * *